US007321207B2

(12) United States Patent
Moon

(10) Patent No.: US 7,321,207 B2
(45) **Date of Patent: *Jan. 22, 2008**

(54) INVERTER APPARATUS AND LIQUID CRYSTAL DISPLAY INCLUDING INVERTER APPARATUS

(75) Inventor: Seung-Hwan Moon, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/209,276

(22) Filed: Aug. 23, 2005

(65) Prior Publication Data

US 2005/0285549 A1 Dec. 29, 2005

Related U.S. Application Data

(63) Continuation of application No. 10/660,023, filed on Sep. 11, 2003, now Pat. No. 6,943,506.

(30) Foreign Application Priority Data

Sep. 12, 2002 (KR) ..... 2002-55303

(51) Int. Cl.
*H05B 37/00* (2006.01)

(52) U.S. Cl. ..... 315/323; 315/324; 315/325

(58) Field of Classification Search ..... 315/323, 315/324, 325; 345/102
See application file for complete search history.

(56) References Cited

U.S. PATENT DOCUMENTS 5,349,269 A 9/1994 Kimball
5,396,155 A 3/1995 Bezdon et al.
5,910,709 A 6/1999 Stevanovic et al.
6,215,680 B1 4/2001 Rolston ..... 363/133
6,335,715 B1 1/2002 Lee ..... 345/87
6,707,264 B2 * 3/2004 Lin et al. ..... 315/307
2002/0003525 A1 1/2002 Hwang
2002/0047530 A1 4/2002 Heike et al.
2002/0047556 A1 4/2002 Tajika et al. ..... 315/169.3
2002/0047619 A1 4/2002 Oura et al. ..... 315/276

FOREIGN PATENT DOCUMENTS

JP 03-252097 11/1991
JP 05-219757 8/1993
JP 06-014556 1/1994
JP 06-111988 4/1994

(Continued)

OTHER PUBLICATIONS

European Search Report for Application No. 03019681.0-2206; Dated: Feb. 23, 2006.

*Primary Examiner*—David Vu
(74) *Attorney, Agent, or Firm*—Cantor Colburn LLP

(57) ABSTRACT

An inverter apparatus for driving a plurality of lamp units including a plurality of lamps is provided. The inverter apparatus includes a plurality of inverters. Each inverter includes a delay block delaying an input ON/OFF signal to generate an output ON/OFF signal and an inverting block controlling the lighting of the corresponding lamp unit based on the output ON/OFF signal. The plurality of inverters includes a first inverter receiving the input ON/OFF signal from an external device and a second inverter receiving the input ON/OFF signal from one of the plurality of inverters.

3 Claims, 5 Drawing Sheets

FOREIGN PATENT DOCUMENTS

| | | | |
|---|---|---|---|
| JP | 07-073980 | | 3/1995 |
| JP | 08-036221 | | 2/1996 |
| JP | 08-280181 | | 10/1996 |
| JP | 09-129387 | | 5/1997 |
| JP | 10-284282 | | 10/1998 |
| KR | 1020000074508 | | 12/2000 |
| TW | 535138 | B | 6/2003 |
| TW | 535358 | B | 6/2003 |

* cited by examiner

INVERTER APPARATUS AND LIQUID CRYSTAL DISPLAY INCLUDING INVERTER APPARATUS

CROSS REFERENCE TO RELATED APPLICATIONS

The present application is a continuation of the earlier filed non-provisional application, having U.S. application Ser. No. 10/660,023, filed on Sep. 11, 2003 now U.S. Pat. No. 6,943,506, which is incorporated herein in its entirety.

BACKGROUND OF THE INVENTION (a) Field of the Invention

The present invention relates to an inverter apparatus and a liquid crystal display including an inverter apparatus.

(b) Description of the Related Art

Display devices used for monitors of computers and television sets include self-emitting displays such as light emitting diodes (LEDs), electroluminescences (ELs), vacuum fluorescent displays (VFDs), field emission displays (FEDs) and plasma panel displays (PDPs) and non-emitting displays such liquid crystal displays (LCDs) requiring light source.

An LCD includes two panels provided with field-generating electrodes and a liquid crystal (LC) layer with dielectric anisotropy interposed therebetween. The field-generating electrodes supplied with electric voltages generate electric field in the liquid crystal layer, and the transmittance of light passing through the panels varies depending on the strength of the applied field, which can be controlled by the applied voltages. Accordingly, desired images are obtained by adjusting the applied voltages.

The light may be emitted from a light source such as a lamp equipped in the LCD or may be natural light. When using the equipped light source, the total brightness of the LCD screen is usually adjusted using an inverter by regulating the ratio of on and off times of the light source or by regulating the current through the light source.

The LCD for a large screen system such as television sets, which is required to have high luminance, includes several inverters, each inverter driving at least one lamp. Accordingly, the volume of the inverter module becomes enlarged and an excessive rush current is generated, when initiating the lighting of the lamps, to cause malfunction of a power supply for the LCD. In order to prevent the problem, the capacity and the volume of the power supply may be enlarged, but it may deteriorate slimness of the LCD.

SUMMARY OF THE INVENTION

A motivation of the present invention is to solve the problems of the conventional art.

According to an embodiment of the present invention, an inverter apparatus for driving a plurality of lamp units, each lamp unit including at least one lamp, is provided, which includes: a plurality of inverters, each inverter including a delay block delaying an input ON/OFF signal to generate an output ON/OFF signal and an inverting block controlling the lighting of the corresponding lamp unit based on the output ON/OFF signal, wherein the plurality of inverters comprise a first inverter receiving the input ON/OFF signal from an external device and a second inverter receiving the input ON/OFF signal from one of the plurality of inverters.

Preferably, the inverters are connected in series and the first inverter is located at an outer side.

The delay block preferably includes: a capacitor; a first switch controlled by the input ON/OFF signal and providing a charging path for the capacitor upon activation; a resistor connected to the capacitor and providing a discharging path for the capacitor; and a second switch controlled by a voltage charged in the capacitor, providing a first voltage as the output ON/OFF signal upon inactivation, and providing a second voltage as the output ON/OFF signal upon activation.

Preferably, the first switch outputs the first voltage as the charging path upon activation and/or the resistor provides the second voltage as the discharging path.

A resistance of the resistor is preferably determined such that time constant for the charging path is different from time constant for the discharging path, and in particular, the time constant for the charging path is smaller than the time constant for the discharging path.

It is preferable that the second switch is activated when the voltage charged in the capacitor is larger than a predetermined value and is inactivated when the voltage charged in the capacitor is smaller than the predetermined value, and the first voltage is larger than the second voltage. A resistance of the resistor is preferably determined such that a charging time of the capacitor is smaller than a discharging time for the capacitor.

The second voltage may be a ground voltage and/or the first switch may include a pnp transistor and the second switch comprises an npn transistor.

Preferably, the first voltage has substantially the same value as a high level of the input ON/OFF signal of the first inverter and the second voltage has substantially the same value as a low level of the input ON/OFF signal of the first inverter.

An inverter apparatus for driving a plurality of lamp units including first and second lamp units, each lamp unit including at least one lamp, is provided, which includes: a delay block receiving an input ON/OFF signal and stepwise delaying the input ON/OFF signal to generate a plurality of output ON/OFF signals; and a plurality of inverters controlling the lighting of the respective lamp units based on the respective output ON/OFF signals.

The delay block preferably includes a plurality of RC circuits connected in series and one of the RC circuits receives the input ON/OFF signal.

A liquid crystal display is provided, which includes: a panel assembly including a plurality of pixels, a plurality of gate lines connected to the pixels, and a plurality of data lines connected to the pixels; a plurality of lamp units for illuminating the panel assembly; a gate driver for providing signals for the gate lines; a data driver for providing signals for the data lines; a controller for providing image signals for the data driver and control signals for the gate driver and the data driver and generating an ON/OFF signal for driving the lamp units; a delay block delaying the ON/OFF signal from the controller; and an inverting block controlling the lighting of one of the lamp units based on the delayed ON/OFF signal.

An exemplary delay block includes: a capacitor; a first transistor controlled by the ON/OFF signal and providing a charging path for the capacitor upon activation; a resistor connected to the capacitor and providing a discharging path for the capacitor; and a second transistor controlled by a voltage charged in the capacitor, providing a first voltage as the delayed ON/OFF signal upon inactivation, and providing a second voltage as the delayed ON/OFF signal upon activation.

A resistance of the resistor is preferably determined such that time constant for the charging path is different from time constant for the discharging path.

It is preferable that the second transistor is activated when the voltage charged in the capacitor is larger than a predetermined value and is inactivated when the voltage charged in the capacitor is smaller than the predetermined value, the first voltage is larger than the second voltage, and a resistance of the resistor is determined such that a charging time of the capacitor is smaller than a discharging time for the capacitor.

Another exemplary delay block includes an RC circuit.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
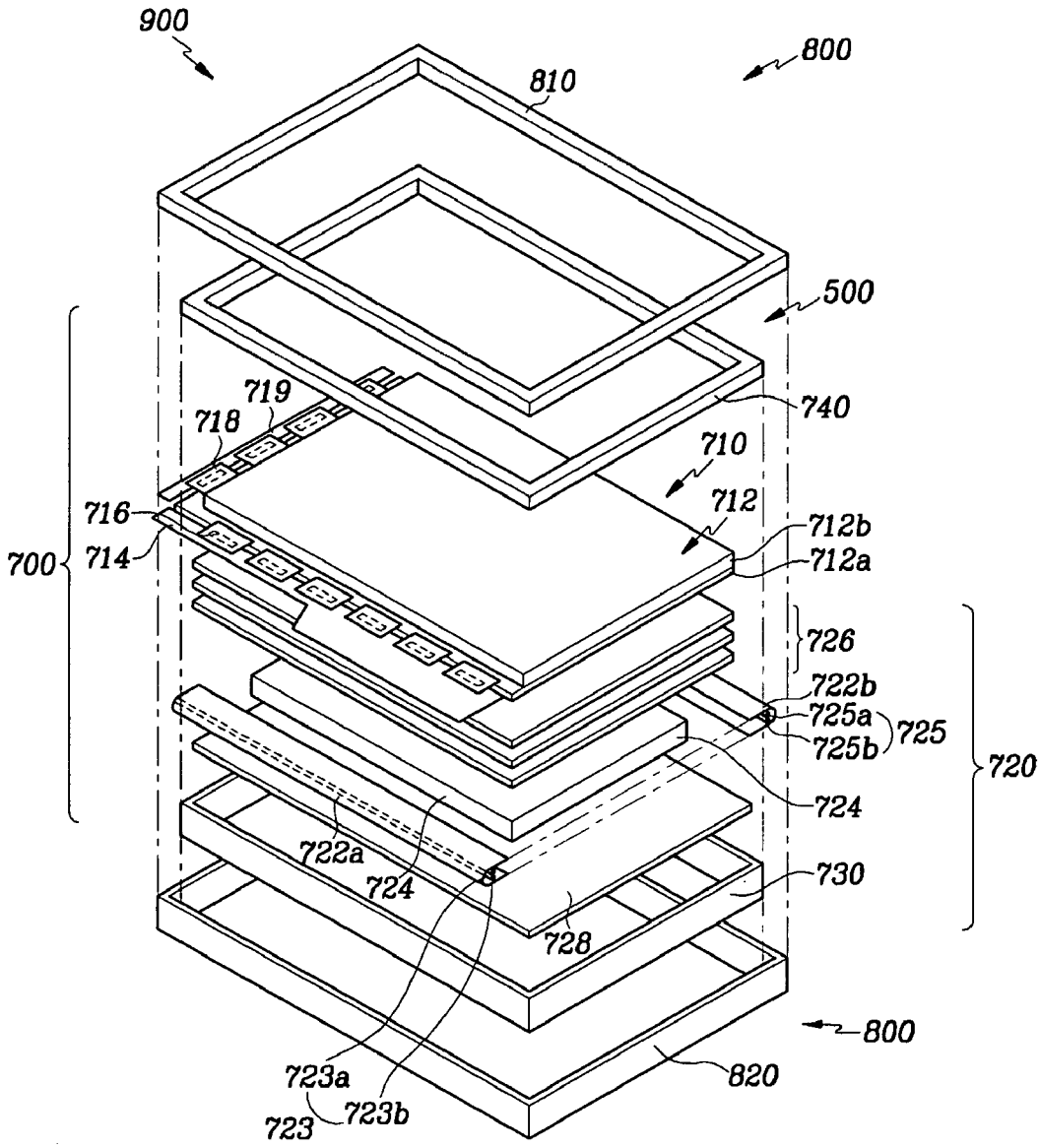
FIG. 1 is an exploded perspective view of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

FIG. 1 is an exploded perspective view of an LCD according to an embodiment of the present invention.

In structural view, an LCD 900 according to an embodiment of the present invention includes a LC module 700 including a display unit 710 and a backlight unit 720, and a pair of front and rear cases 810 and 820, a chassis 740, and a mold frame 730 containing and fixing the LC module 700 as shown in FIG. 1.

The display unit 710 includes the LC panel assembly 712, a plurality of gate tape carrier packages (TCPs) 718 and a plurality of data TCPs 716 attached to the LC panel assembly 712, and a gate printed circuit board (PCB) 719 and a data PCB 714 attached to the associated TCPs 718 and 716, respectively.

The LC panel assembly 712, in structural view shown in FIG. 1, includes a lower panel 712*a*, an upper panel 712*b* and a liquid crystal layer (not shown) interposed therebetween while it includes a plurality of display signal lines (not shown) and a plurality of pixels (not shown) connected thereto and arranged substantially in a matrix in circuital view.

The display signal lines are provided on the lower panel 712*a* and include a plurality of gate lines (not shown) transmitting gate signals (called scanning signals) and a plurality of data lines (not shown) transmitting data signals. The gate lines extend substantially in a row direction and are substantially parallel to each other, while the data lines extend substantially in a column direction and are substantially parallel to each other.

Each pixel includes a switching element connected to the display signal lines, and an LC capacitor and a storage capacitor that are connected to the switching element. The storage capacitor may be omitted if unnecessary.

The switching element such as a TFT is provided on the lower panel 712*a* and has three terminals: a control terminal connected to one of the gate lines; an input terminal connected to one of the data lines; and an output terminal connected to the LC capacitor and the storage capacitor.

The LC capacitor includes a pixel electrode (not shown) on the lower panel 712*a*, a common electrode (not shown) on the upper panel 712*b*, and the LC layer as a dielectric between the electrodes. The pixel electrode is connected to the switching element and preferably made of transparent conductive material such as indium tin oxide (ITO) and indium zinc oxide (IZO) or reflective conductive material. The common electrode covers the entire surface of the upper panel 712*a* and is preferably made of transparent conductive material such as ITO and IZO and supplied with a common voltage. Alternatively, both the pixel electrode and the common electrode, which have shapes of bars or stripes, are provided on the lower panel 712*a*.

The storage capacitor is an auxiliary capacitor for the LC capacitor. The storage capacitor includes the pixel electrode and a separate signal line (not shown), which is provided on the lower panel 712*a*, overlaps the pixel electrode via an insulator, and is supplied with a predetermined voltage such as the common voltage. Alternatively, the storage capacitor includes the pixel electrode and an adjacent gate line called a previous gate line, which overlaps the pixel electrode via an insulator.

For color display, each pixel represent its own color by providing one of a plurality of red, green and blue color filters in an area occupied by the pixel electrode. The color filter is provided in the corresponding area of the upper panel 712*b*. Alternatively, the color filter is provided on or under the pixel electrode on the lower panel 712*a*.

Referring to FIG. 1, the backlight unit 720 includes a plurality of lamps 723 and 725 disposed near edges of the LC panel assembly 712, a pair of lamp covers 722*a* and 722*b* for protecting the lamps 723 and 725, a light guide 724 and a plurality of optical sheets 726 disposed between the panel assembly 712 and the lamps 723 and 725 and guiding and diffusing light from the lamps 723 and 725 to the panel assembly 712, and a reflector 728 disposed under the lamps 723 and 725 and reflecting the light from the lamps 723 and 725 toward the panel assembly 712.

The light guide 724 is an edge type and has uniform thickness, and the number of the lamps 723 and 725 is determined in consideration of the operation of the LCD.

The lamps 723 and 725 preferably include fluorescent lamps such as CCFL (cold cathode fluorescent lamp) and EEFL (external electrode fluorescent lamp). An LED is another example of the lamp 723 and 725.

A pair of polarizers (not shown) polarizing the light from the lamps 723 and 725 are attached on the outer surfaces of the panels 712*a* and 712*b* of the panel assembly 712.

The TCPs 716 and 718 are a kind of flexible printed circuit (FPC) films and attached to edges of the LC panel assembly 712. A plurality of data driving integrated circuit (IC) chips connected to the data lines of the LC panel assembly 712 and applying data voltages thereto are mounted on the data TCP 716. Similarly, plurality of gate driving IC chips connected to the gate lines of the LC panel assembly 712 and applying gate voltages thereto after combining a gate-on voltage and a gate-off voltage are mounted on the data TCP 718.

The PCBs 714 and 719 are connected to the TCPs 716 and 718 and include circuit elements for receiving image signals and input control signals for controlling the image signals, processing the image signals, and generating output control signals for the processed image signals to be provided for the driving ICs on the TCPs 716 and 718.

According to other embodiments of the present invention, the gate driving circuits and/or the data driving circuits are chip-mounted on the lower panel 712*a*, while one or both of the driving circuits are incorporated along with other elements into the lower panel 712*a*. The gate PCB 719 and/or the gate FPC films 718 may be omitted in both cases.

Now, an LCD including an inverter apparatus according to an embodiment is described in detail with reference to FIGS. 2 and 3.

Figure 2:
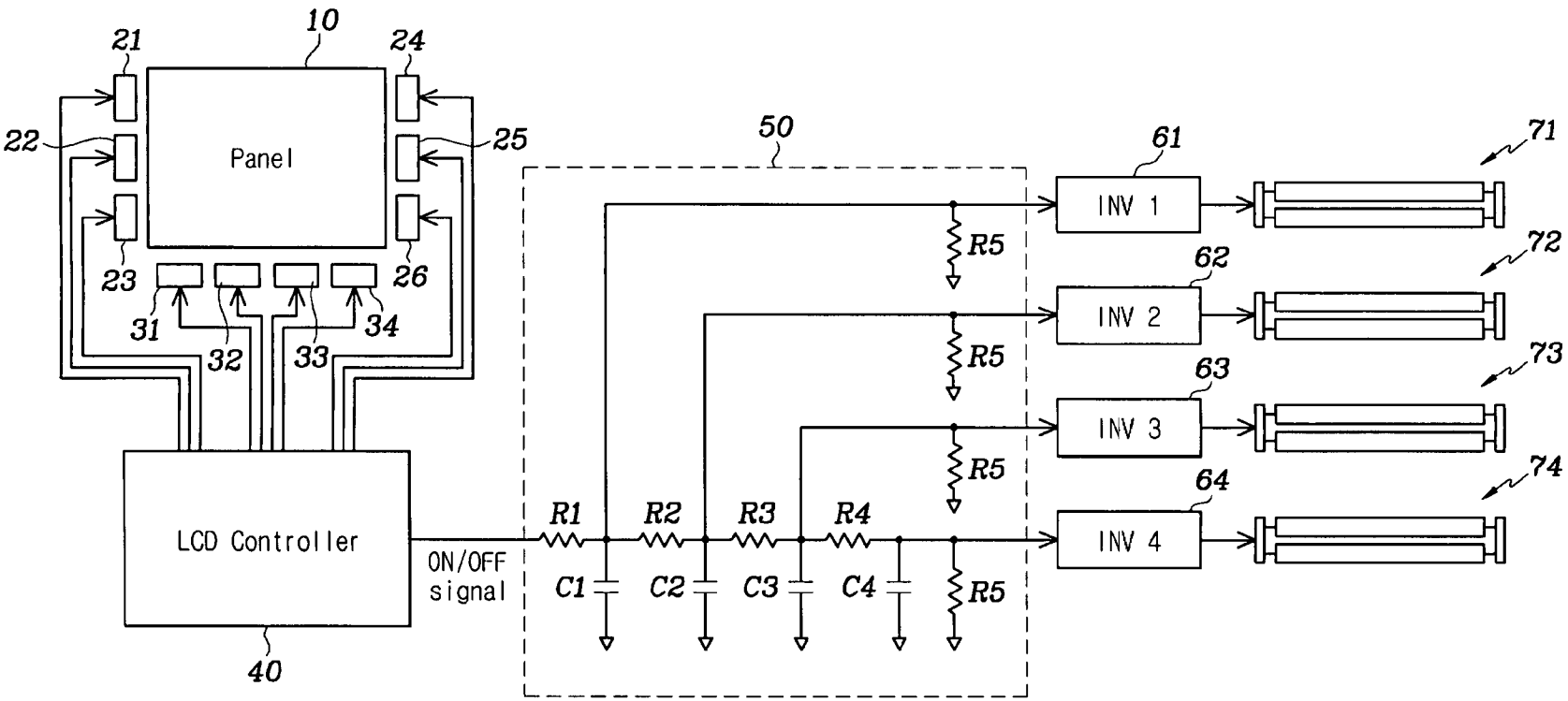
FIG. 2 is a block diagram of an LCD according to an embodiment of the present invention.

FIG. 2 is a block diagram of an LCD according to an embodiment of the present invention.

Referring to FIG. 2, an LCD according to an embodiment includes a LC panel assembly 10, a plurality of the gate driving ICs 21–26 attached to opposite edges of the LC panel assembly 10, a plurality of data driving ICs 31–34 attached to an edge of the LC panel assembly 10, a LCD controller 40, a delay block 50 connected to the LCD controller 40, first to fourth inverters 61–64 connected to the delay block 50, and first to fourth lamp units 71–74 connected to the first to the fourth inverters 61–64, respectively. The LC panel assembly 10 shown in FIG. 2 corresponds to reference numeral 712 in FIG. 1.

Each lamp unit 71–74 includes two lamps connected in parallel as shown in FIG. 2, which correspond to the lamps 723*a* and 723*b* or 725*a* and 725*b* shown in FIG. 1.

The LCD controller 40 is connected to the gate driving ICs 21–26, data driving ICs 31–34, and the delay block 50 and is mounted on one of the PCBs 714 and 719.

The delay circuit 50 includes four RC circuits R1 and C1, R2 and C2, R3 and C3, and R4 and C4 (abbreviated as Ri-Ci), and four input resistors R5 connected to the respective RC circuits Ri-Ci. The RC circuits Ri-Ci are connected in series and connected to the respective inverters 61–64. The first RC circuit R1 and C1 is supplied with an ON/OFF signal from the LCD controller 40.

The number of the inverters and the number of the lamps in each lamp unit, etc. are not limited to the above-described embodiment.

Now, an operation of the LCD will be described in detail with reference to FIGS. 2 and 3.

Figure 3:
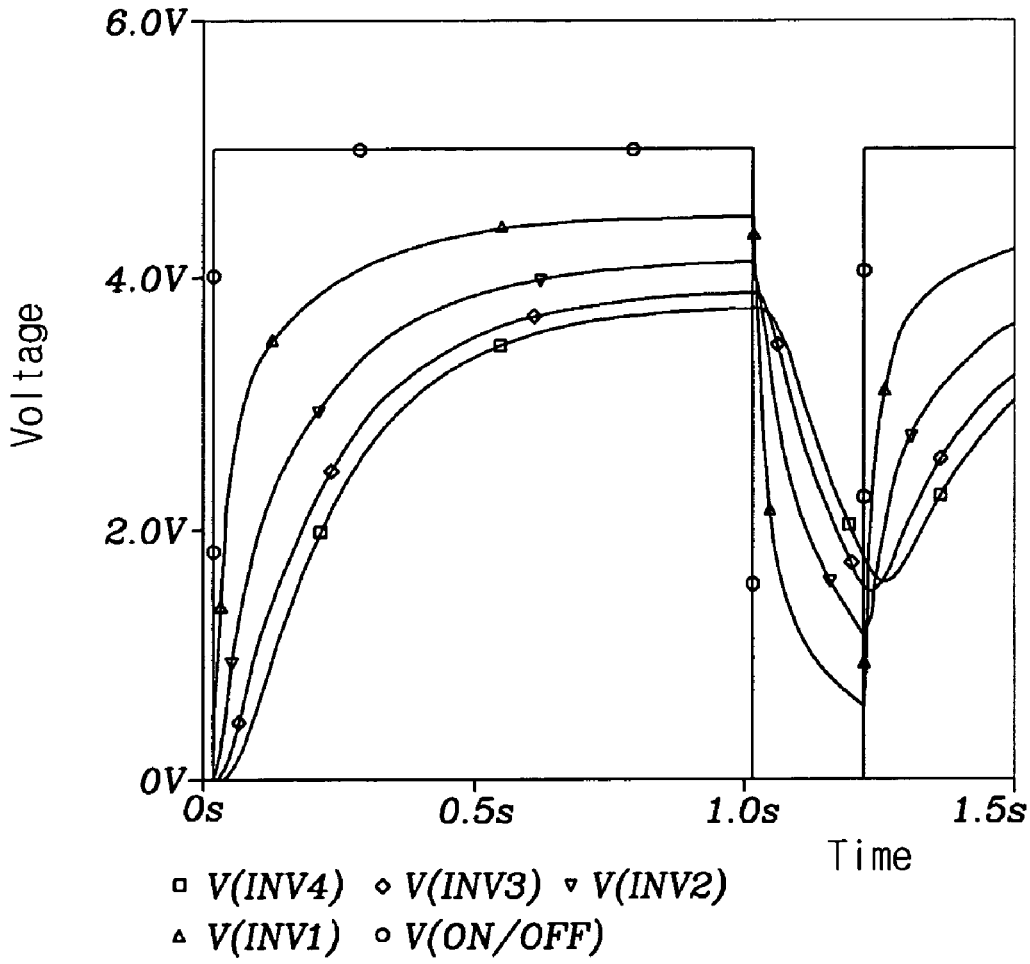
FIG. 3 shows exemplary waveforms of an ON/OFF signal entering into a delay block and stepwise delayed ON/OFF signals entering into inverters in the LCD shown in FIG. 2.

FIG. 3 shows exemplary waveforms of an ON/OFF signal entering into a delay block 50 and sequentially delayed ON/OFF signals entering into inverters.

The LCD controller 40 is supplied with RGB image signals and input control signals controlling the display thereof such as a vertical synchronization signal, a horizontal synchronization signal, a main clock, and a data enable signal, from an external information processing device such as a computer or television sets. After generating a plurality of control signals and processing the image signals suitable for the operation of the panel assembly 10 on the basis of the input control signals and the input image signals, the LCD controller 40 provides the control signals for the gate driving ICs 521–26, the data driving ICs 31–34, and the delay block 50, and provides the processed image signals for the data driving ICs 31–34.

The control signals include a vertical synchronization start signal for informing of start of a frame, a gate clock signal for controlling the output time of the gate-on voltage, and an output enable signal for defining the width of the gate-on voltage. The control signals further include a horizontal synchronization start signal for informing of start of a horizontal period, a load signal for instructing to apply the appropriate data voltages to the data lines, an inversion control signal for reversing the polarity of the data voltages (with respect to the common voltage) and a data clock signal. The control signals also include an ON/OFF signal for controlling the lighting of the lamp units 71–74.

The data driving ICs 31–34 receives a packet of the image data for a pixel row from the LCD controller 40 and converts the image data into the analog data voltages selected from a plurality of gray voltages in response to the control signals from the LCD controller 40.

Responsive to the control signals from the LCD controller 40, the gate driving ICs 521–26 applies the gate-on voltage to the gate line, thereby turning on the switching elements connected thereto.

The data driving ICs 31–34 applies the data voltages to the corresponding data lines for a turn-on time of the switching elements (which is called "one horizontal period" or "1H" and equals to one periods of the horizontal synchronization signal, the data enable signal, and the gate clock signal). Then, the data voltages in turn are supplied to the corresponding pixels via the turned-on switching elements.

The difference between the data voltage and the common voltage applied to a pixel is expressed as a charged voltage of the LC capacitor, i.e., a pixel voltage. The liquid crystal molecules have orientations depending on the magnitude of the pixel voltage.

In the meantime, the delay block 50 sequentially delays the ON/OFF signal and supplies the sequentially delayed ON/OFF signal to the inverters 61–64 in sequence. Each RC circuit Ri-Ci delays the ON/OFF signal by an amount of time constant determined by the resistance of the resistor R1–R4 and the capacitance of the capacitor C1–C4. Accordingly, the phases of input signals entering into the inverters 61–64 are differentiated by the time constant. FIG. 3 shows exemplary waveforms of the ON/OFF signal V(ON/OFF) entering into the delay block 50 and the sequentially delayed ON/OFF signals V(INV1), V(INV2), V(INV3) and V(INV4) entering into the inverters 61, 62, 63 and 64, respectively.

The inverters 61–64 sequentially turn on and off the lamps of the lamp units 71–74 based on the sequentially delayed ON/OFF signal from the delay block 50 as well as other control signal from the LCD controller 40 or an external device. Therefore, the lamp units 71–74 are sequentially turned on and off at intervals determined by the time constant, which are order of tens of microseconds. The sequential lighting of the lamp units 71–74 prevents excessive rush current. The inverters 61–64 drives the lamp units 71–74 in a way that it converts a DC voltage into an AC voltage, boosts the AC voltage, and supplies the boosted AC voltage to the lamp units 71–74.

The light from the lamp units 71–74 passes through the liquid crystal layer and varies its polarization according to the orientations of the liquid crystal molecules. The polarizers convert the light polarization into the light transmittance.

By repeating this procedure, all gate lines are sequentially supplied with the gate-on voltage during a frame, thereby applying the data voltages to all pixels. When the next frame starts after finishing one frame, the inversion control signal applied to the data driving ICs 31–34 is controlled such that the polarity of the data voltages is reversed (which is called "frame inversion"). The inversion control signal may be also controlled such that the polarity of the data voltages flowing in a data line in one frame are reversed (which is called "line inversion"), or the polarity of the data voltages in one packet are reversed (which is called "dot inversion").

As described above, this embodiment prevents excessive rush current by sequentially lighting the lamp units 71–74. Since the lighting interval determined by the time constant is very short, the sequential lighting is not recognized by human eyes.

An LCD including an inverter apparatus according to another embodiment of the present invention is now described in detail with reference FIGS. 4–6.

Figure 4:
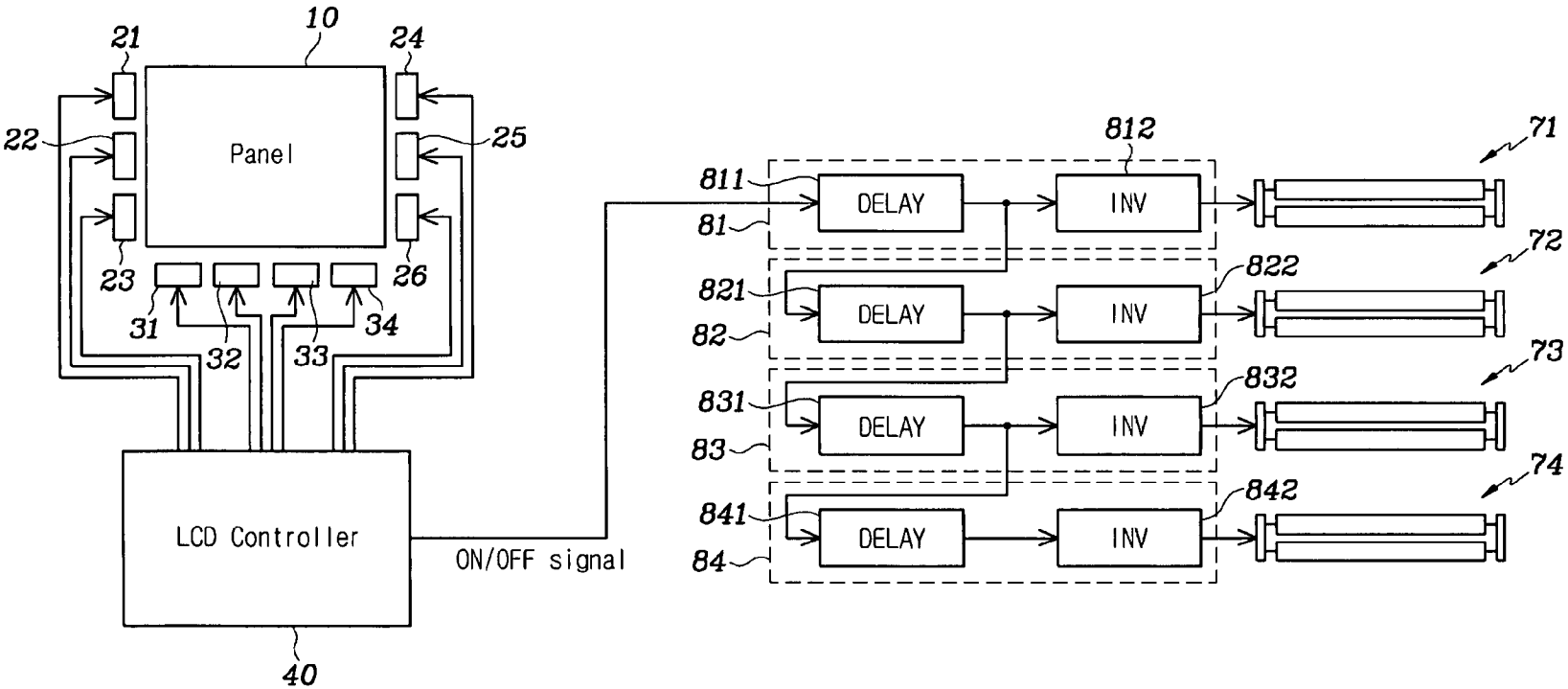
FIG. 4 is a block diagram of an LCD according to another embodiment of the present invention.
Figure 5:
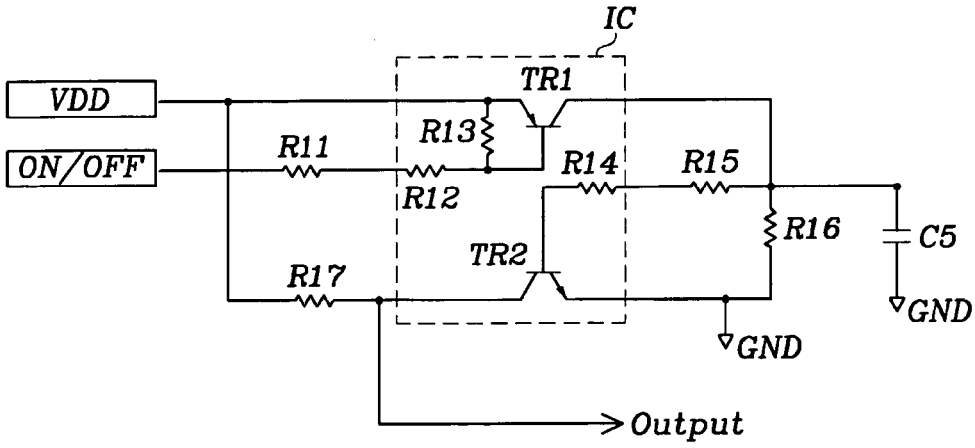
FIG. 5 is an exemplary circuit diagram of the LCD shown in FIG. 4.

FIG. 4 is a block diagram of an LCD according to another embodiment of the present invention and FIG. 5 is an exemplary circuit diagram of the LCD shown in FIG. 4.

Referring to FIG. 4, an LCD according to another embodiment of the present invention includes a LC panel assembly 10, a plurality of the gate driving ICs 21–26, a plurality of data driving ICs 31–34, a LCD controller 40, first to fourth inverters 81–84, and first to fourth lamp units 71–74 connected to the first to the fourth inverters 81–84, respectively.

Each inverter 81–84 includes a delay block (DELAY) 811, 821, 831 or 841 (abbreviated as 811–841 hereinafter) and an inverting block (INV) 812, 822, 832 or 842 (abbreviated as 812–842 hereinafter) connected between the delay block 811–841 and the corresponding lamp unit 71–74. The first inverter 81 receives an ON/OFF signal for controlling the lighting of the lamps of the lamp units 71–74. Alternatively, the ON/OFF signal can be entered into any outer inverter. An output of each delay block 811, 821 or 831 is entered into a next delay block 821, 831 or 841.

Referring to FIG. 5, an exemplary delay block includes a pair of switching transistors TR1 and TR2, a capacitor C5, and a plurality of resistors R11–R17.

The pnp transistor TR1 has an emitter supplied with a supply voltage VDD, a collector connected to the capacitor C5, and a base connected to an ON/OFF signal via the resistors R11 and R12. The emitter and the base of the transistor TR1 are connected to each other via the resistor R13.

The npn transistor TR2 has an emitter supplied with another supply voltage GND such as a ground voltage, a collector supplied with the supply voltage VDD via the resistor R17, and a base connected to the capacitor C5 via the resistors R14 and R15.

The capacitor C5 is connected between the collector of the transistor TR1 and the ground voltage GND and the resistor R16 is connected in parallel to the capacitor C5.

The resistors R13, R14, R15 and R17 are provided for circuit configuration and a block IC enclosed by a dotted rectangle can be made into an integrated circuit. The output of the delay block is connected to the collector of the transistor TR2.

The operation of the delay block is described in detail with reference to FIGS. 4–6.

FIG. 4 shows exemplary waveforms of an ON/OFF signal entering into a delay block 811 of the first inverter 81 and sequentially delayed ON/OFF signals from the delay blocks 811–841.

When the ON/OFF signal input into the base of the transistor TR1 is in an off state, the transistor TR1 turns on to start charging the capacitor C5 with the supply voltage VDD. When the voltage across the capacitor C5 is increased to reach a predetermined level, the transistor TR2 also turns on such that the output of the delay block becomes the ground voltage GND.

When the ON/OFF signal input into the delay circuit 81 becomes in an on state, the transistor TR1 turns off to discharge the voltage across the capacitor C5. The discharging is made via the resistor R16 and an appropriate value of the resistance of the resistor R16 may make a desired discharging time. When the voltage across the capacitor C5 is decreased to reach a predetermined level, the transistor TR2 turns off such that the output of the delay block becomes the supply voltage VDD with a voltage drop due to the resistor R17.

Figure 6:
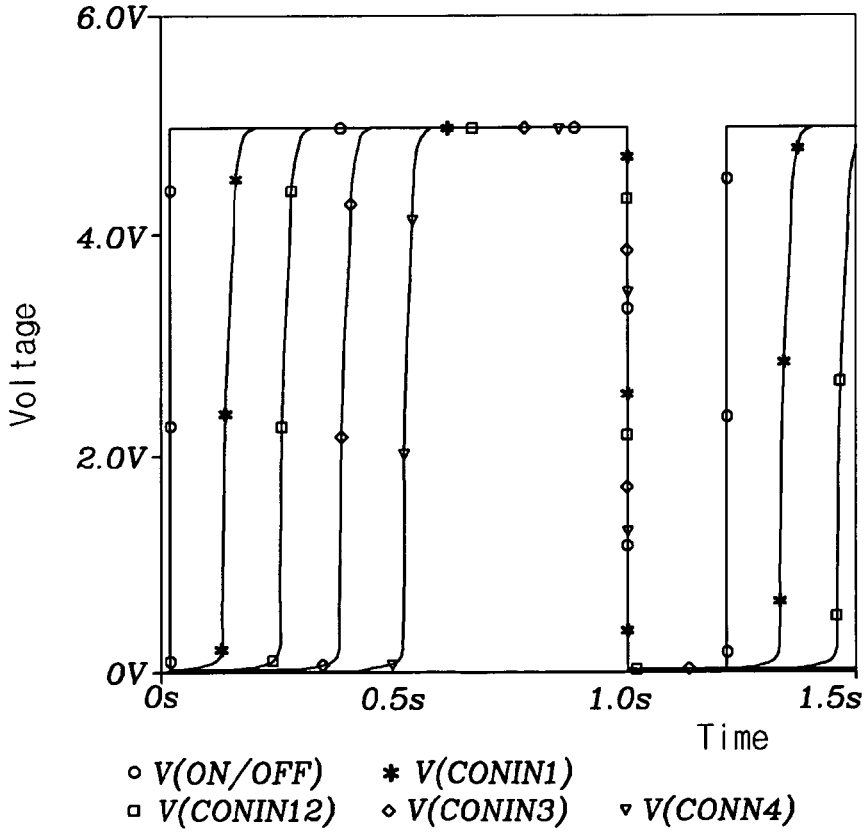
FIG. 6 shows exemplary waveforms of an ON/OFF signal entering into a delay block and stepwise delayed ON/OFF signals entering into inverters in the LCD shown in FIGS. 4 and 5.

In this way, the delay block generates a delayed ON/OFF signal and FIG. 6 shows exemplary waveforms of the ON/OFF signal V(ON/OFF) entering into the delay block and the sequentially delayed ON/OFF signals V(CONIN1), V(CONIN2), V(CONIN3) and V(CONIN4) entering into the inverters 81, 82, 83 and 84, respectively.

Since the delay block shown in FIG. 5 generates the delayed ON/OFF signal by using separate supply voltages VDD and GND instead of directly using the input ON/OFF signal, the decrease of the voltage level of the ON/OFF signal when directly using the input ON/OFF signal.

Furthermore, the separation of a charging path and a discharging path for the capacitor C5 enable to differentiate the charging time and the discharging time determined by the time constants of the charging path and the discharging path such that the discharging time or the charging time is so short to rapidly respond to the input ON/OFF signal. In detail, the capacitor C5 is rapidly charged when the transistor Q1 turns on since the capacitor C5 is directly connected to the supply voltage VDD. On the contrary, the discharging time of the capacitor C5 is relatively long since the capacitor C5 is connected to the ground voltage GND via the resistor R16.

It is preferable that the supply voltages VDD and GND have the same value as the on level and the off level of the initial ON/OFF signal, respectively.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A backlight unit comprising:

a plurality of lamps;

a plurality of inverters controlling the lighting of at least one of the lamps;

a delay circuit as a driving signal generator receiving an input signal and generating at least two output signals for driving the inverters, the output signals each having a different phase from each other, wherein the delay circuit comprises a plurality of RC circuits connected in series and one of the RC circuits receives the input signal.

2. The backlight unit of claim 1, wherein the delay circuit comprises a plurality of input resistors connected to the respective RC circuits.

3. The backlight unit of claim 2, wherein the RC circuits are connected to the respective inverters.

* * * * *